US007208454B2

(12) United States Patent
Park et al.

(10) Patent No.: US 7,208,454 B2
(45) Date of Patent: Apr. 24, 2007

(54) CLEANING SOLUTION FOR REMOVING ANTI-REFLECTIVE COATING COMPOSITION

(75) Inventors: Dong-Jin Park, Osan-si (KR); Kyung-Dae Kim, Suwon-si (KR); Hoi-Sik Chung, Seoul (KR); Pil-Kwon Jun, Seoul (KR); Young-Ho Kim, Suwon-si (KR)

(73) Assignee: Samsung Electronics Co., Ltd., Suwon, Kyungki-do (KR)

( * ) Notice: Subject to any disclaimer, the term of this patent is extended or adjusted under 35 U.S.C. 154(b) by 291 days.

(21) Appl. No.: 10/885,951

(22) Filed: Jul. 8, 2004

(65) Prior Publication Data

US 2004/0238012 A1 Dec. 2, 2004

Related U.S. Application Data

(62) Division of application No. 10/136,370, filed on May 2, 2002, now Pat. No. 6,777,379.

(30) Foreign Application Priority Data

May 2, 2001 (KR) ..... 2001-23774

(51) Int. Cl.
*C11D 7/50* (2006.01)

(52) U.S. Cl. ..... 510/175; 510/176; 134/3

(58) Field of Classification Search ..... None
See application file for complete search history.

(56) References Cited

U.S. PATENT DOCUMENTS 4,778,536 A 10/1988 Grebinski
5,273,676 A * 12/1993 Boeckh et al. ..... 510/360
5,733,342 A * 3/1998 Greindl et al. ..... 8/137
5,780,406 A * 7/1998 Honda et al. ..... 510/175
5,821,173 A 10/1998 Takiyama
5,910,453 A 6/1999 Gupta et al.
6,033,993 A * 3/2000 Love et al. ..... 438/745
6,130,195 A 10/2000 Doyel et al.
6,136,649 A 10/2000 Hui et al.
6,306,564 B1 10/2001 Mullee
6,361,712 B1 * 3/2002 Honda et al. ..... 252/79.3
6,589,439 B2 * 7/2003 Honda et al. ..... 216/107
2001/0032829 A1 * 10/2001 Honda et al. ..... 216/108

FOREIGN PATENT DOCUMENTS

KR 1998-048608 9/1998
KR 1998-084217 12/1998

* cited by examiner

*Primary Examiner*—Gregory Webb
(74) *Attorney, Agent, or Firm*—Lee & Morse, P.C.

(57) ABSTRACT

A cleaning solution for a cured anti-reflective layer (AFC layer) component and a method of cleaning an anti-reflective layer component by using the same, wherein the cleaning solution comprises about 5–30% by weight of ammonium hydroxide, about 23–70% by weight of an organic solvent and about 10–50% by weight of water. When an organic material is spattered to adjacent equipment during implementing a coating process onto a wafer, the equipment is detached and then is dipped into the cleaning solution. Thereafter, the equipment is rinsed and dried. Cured and non-cured organic materials are advantageously removed. Cured organic materials left for a period of time, particularly anti-reflective layer components are advantageously removed.

5 Claims, 4 Drawing Sheets

CLEANING SOLUTION FOR REMOVING ANTI-REFLECTIVE COATING COMPOSITION

This application is a DIVISION of application Ser. No. 10/136,370, filed May 2, 2002 now U.S. Pat. No. 6,777,379.

BACKGROUND OF THE INVENTION

1. Field of the Invention

The present invention relates to a cleaning solution and a method of cleaning an anti-reflective coating (ARC) composition using the same and, more particularly, to a method of cleaning accumulated and cured ARC compositions remaining on semiconductor manufacturing equipment.

2. Description of the Related Arts

Recently, as digital information has become more widely adopted, the use of computers has become widely spread. With increasing amounts of digital information becoming available and with the growing need to process greater amounts of digital information, there is an ever-growing demand and requirement placed on semiconductor devices for faster operating speeds as well as for handing and processing greater amounts of digital data. In order to satisfy these requirements, manufacturing methods for semiconductor devices have been developed to increase the degree of integration, increase reliability and increase processing and response time. In order to increase the degree of integration in semiconductor devices, efforts have been and are being made towards reducing the cell size and margin of all of the patterns formed on a semiconductor substrate. On the other hand, a vertical size of semiconductor devices, that is, an aspect ratio of each element making up the semiconductor device, has increased.

Current day semiconductor devices generally include a transistor structure with appropriate doping regions, a capacitor, and an electrical interconnection pattern to connect these various components. The manufacture of current day semiconductor devices requires a multitude of process steps, including photolithography, doping, etching and thin film deposition. Among these process steps, one of the most important areas of semiconductor manufacturing process that has enabled high levels of semiconductor device integration is photolithography.

Photolithography is a basic process that is essential to current day semiconductor fabrication. Every semiconductor device requires at least several photolithography processes to form desired circuit patterns as mandated by its design. As the design of semiconductor devices dictate higher levels of integration, the role of photolithography becomes more important.

Photolithography may be used for patterning a semiconductor substrate, a metal layer, an insulating layer, etc. in the manufacture of an integrated circuit of a semiconductor device. Although the technical details of how photolithography is carried out are complex, the theory of photolithography is relatively easy to describe.

In order to form a pattern using photolithography, a photoresist film or layer is formed on a device wafer surface to be patterned, such as on an insulating layer or a conductive layer on a substrate. The photoresist film or layer may be made of an organic compound, the solubility of which to an alkaline solution changes after exposure to a light source, e.g., ultraviolet (UV) light or an X-ray. The photoresist film or layer is exposed by a light source through a photomask having a pattern to be transferred onto the device wafer surface. The photoresist film is then developed to remove those portions of the photoresist film having a high solubility (i.e., exposed portions for a positive type photoresist), while remaining portions having a low solubility (i.e., unexposed portions for a positive type photoresist) form a photoresist pattern. Layers underlying the photoresist pattern are then etched using the photoresist pattern as an etching mask, and thereafter the photoresist pattern may be removed to obtain a pattern used in forming conductive patterns, wiring, electrodes, as well as other components of a semiconductor device. However, as the level of integration increases and the size of devices become smaller, the photoresist compound used for the photolithography process poses various problems. One of these problems relates to diffused reflection during exposure of a photoresist layer. To address this problem, an organic anti-reflecting coating ("ARC") process has been employed to minimize diffused reflection.

As described above, photolithography is used to form a pattern of an underlying layer using a photoresist onto which an optical phase can be formed. The optical phase corresponds to a transferring pattern to be formed on the underlying layer. After exposure and development of the photoresist film, the photoresist pattern is formed. However, as the size of semiconductor devices become smaller, e.g., to the degree of 0.35 microns or less, the wavelength of the light used for the exposure becomes shorter. Accordingly, the degree of reflection and scattering of light at the underlying layer increases with undesired exposure characteristics. For example, the undesired exposure might change the channel depth (CD) of small size devices.

In order to address the above-described problem, an ARC layer is formed between the photoresist film and the underlying layer. The thickness of the ARC layer is formed to be about 1000 Å or less. Accordingly, the ARC layer is very thin when compared with that of the photoresist film. In order to pattern the underlying layer after developing the photoresist film, the exposed ARC layer also should be removed.

The ARC layer is generally formed from a composition including a polyimide-based compound, a polyacrylate-based compound, and other like compounds. The thickness of the ARC layer is a function of its refractive index; however, the ARC layer is generally formed to a thickness between about 400–600 Å. The function of the ARC layer is to reduce a refractive coefficient of the exposure light during photolithography to reduce undesired exposure characteristics at the underlying layer due to reflection of the exposure light.

FIG. 1 is a cross-sectional, schematic view of an equipment for coating a photoresist or an organic ARC composition on a semiconductor wafer.

The equipment includes an outer container 10 having a cover at the upper portion thereof, and an inner container 60 containing a spin chuck 20 for supporting a wafer W. The spin chuck 20 is operatively coupled to a drive 30 through a bottom portion of the outer container 10 to rotate the wafer W which is fixed at the upper portion of the spin chuck 20.

The outer container 10 may have the same configuration as the inner container 60. The upper portion of the outer container 10 is maintained at a predetermined distance from the spin chuck 20 in order to prevent spattering of an organic material such as a photoresist material to the outer portion of the outer container 10 during a coating process of the organic material. A nozzle 40 for coating an organic material and a side rinse nozzle 50 are provided at the upper portion of the outer container 10. The nozzles 40 and 50 are movable towards and away from the plane of the wafer W.

The inner container 60 is installed at the inner portion of the outer container 10 to prevent spattering of organic materials such as photoresist compounds to the outer container 10. The inner container 60 is manufactured using a material having heat-resistance, scratch-resistance and low viscous properties. That is, the inner container 60 is comprised of TEFLON, PP (polypropylene), etc. The inner container 60 is periodically detached for a cleaning.

The wafer W positioned on the spin chuck 20 is fixed by vacuum through the spin chuck 20. The nozzle for coating organic material 40 moves downwardly and closer to the wafer W, and then the organic material is coated on the wafer W. At the same time, the spin chuck 20 driven by a driver 30 rotates at a constant velocity and the organic material coated on the surface of the wafer spreads out uniformly by a centrifugal force.

A rinsing solution supplied from the side rinse nozzle 50 removes organic material fixed at the edge portion of the wafer. After completing the rinsing operation, the rinsing solution is exhausted out through an exhausting pipe 70 provided through a bottom portion of the inner container 60. After completing the coating of the wafer with the organic material, the nozzle 40 for coating organic material and the side rinse nozzle 50 are moved upwardly, and the rotation of the spin chuck 20 stops. Then, the wafer coated with the organic material is transferred for implementing the next process.

The ARC layer formed on the wafer for the manufacture of a semiconductor device can be removed through an ashing process by using an ARC removing etching solution or plasma; however, the organic ARC adheres and cures on the inner container, and cannot be removed by the above methods. The inner container 60 is detached periodically and the fixed organic materials on the surface of the inner container are removed by a scratching method. This method requires a long time and reduces manufacturing productivity.

Accordingly, the viscosity of the ARC composition or the photoresist is controlled to an appropriate degree so that the coated composition on the wafer does not overflow the wafer. In addition, the rotational velocity also is controlled to an appropriate degree. However, the spattering of the organic material during implementation of the process is inevitable.

At this time, the cured organic ARC composition is hardened more than the photoresist and is difficult to remove. The cured organic ARC composition contaminates the equipment for implementing the photolithography process and causes various problems.

The above-described problems may be resolved by rinsing the inner container soon after applying the photoresist or organic ARC composition and by advantageously removing the organic materials. However, stopping the operation of the equipment for cleaning results in a reduction in production yield and is practically impossible. Accordingly, the photoresist or organic ARC composition that is overflowed or spattered on the equipment during the operation of the equipment is allowed to remain as it stands, and removal effort is implemented only once every one or two weeks. The organic material adhering on the equipment may become harder after a long lapse of time, and the removal thereof becomes all the more difficult.

Generally, the photoresist is easier to remove than the organic ARC. Some methods generally employed for the removal of these cured organic materials are as follows. First, the photoresist and the ARC may be removed by physically scratching the cured organic materials with a plastic bar. Second, the photoresist may be chemically removed, and the ARC may be removed through the scratching. Otherwise, the equipment is replaced with a new replacement. All of these methods, however, have negative and deleterious consequences on the manufacturing process of semiconductor devices. For example, the amount of time that is required to clean a single equipment is about 30 minutes, and this lost time has the effect of reducing not only the equipment cleaning efficiency but the overall manufacturing efficiency as well. Moreover, contaminant particles generated by physical abrasion and scratching during the cleaning requires proper elimination and disposal.

Proper cleaning and removal of contaminant materials from equipment is required for conducting semiconductor processes. While various methods are in practice, there is still a need for improved methods that reduce cleaning time without the negative consequences and impact to the manufacturing process.

SUMMARY OF THE INVENTION

A feature of an embodiment of the present invention is to provide a novel cleaning solution by which cleaning of equipment may be improved by effectively removing accumulated photoresist or organic ARC compositions during implementing a photolithography process.

Another feature of an embodiment of the present invention is to provide a method of cleaning an organic ARC composition or component using the novel cleaning solution.

The present invention is made possible by through using the concepts of a swelling, a solvency power and a polarity of the novel cleaning solution.

In accordance with a preferred embodiment of the present invention, there is provided a cleaning solution comprising about 5–30% by weight of ammonium hydroxide salt, about 23–70% by weight of an organic solvent and about 10–50% by weight of water.

The ammonium hydroxide salt is at least one selected from the group consisting of $(NH_3OH)_2SO_4$, $NH_3OHCl$, $NH_3OHNO_3$ and $(NH_3OH)PO_4$. The organic solvent is at least one selected from the group consisting of acetone, acetonitrile and MIBK (methyl isobutyl ketone).

In accordance with another preferred embodiment of the present invention, there is provided a method of cleaning an organic component comprising, coating an organic material on a semiconductor wafer mounted in an equipment, separating the equipment and dipping the equipment into a cleaning solution comprising about 5–30% by weight of ammonium hydroxide salt, about 23–70% by weight of an organic solvent and about 10–50% by weight of water. Thereafter, the equipment may be rinsed and dried. Through this method, both cured and non-cured organic material may be effectively and efficiently removed.

It is preferred that the dipping of the equipment into the cleaning solution is conducted for about 5–15 minutes. An inner container installed in the equipment wraps the wafer at a predetermined distance from both the equipment and the wafer.

The present invention provides a cleaning solution for removing organic materials, particularly organic ARC compositions, to improve the effectiveness and efficiency of equipment cleaning as well the overall semiconductor manufacture and process.

These and other features and aspects of the present invention will be readily apparent to those of ordinary skill in the art upon review of the detailed description that follows.

BRIEF DESCRIPTION OF THE DRAWINGS

The above features and advantages of the present invention will become more apparent by describing preferred embodiments in detail with reference to the attached drawings in which.

DETAILED DESCRIPTION OF THE INVENTION

Korean Patent Application No. 2001-23774, filed May 2, 2001, and entitled: "Cleaning Solution and Method of Cleaning Anti-Reflective Coating Composition Using the Same," is incorporated by reference herein in its entirety.

The present invention will now be described in detail with reference to the drawings. FIGS. 2A–2E are cross-sectional views of a semiconductor device illustrating a semiconductor process in which a photoresist film and an organic ARC layer are applied in accordance with a preferred embodiment of the present invention.

Figure 1:
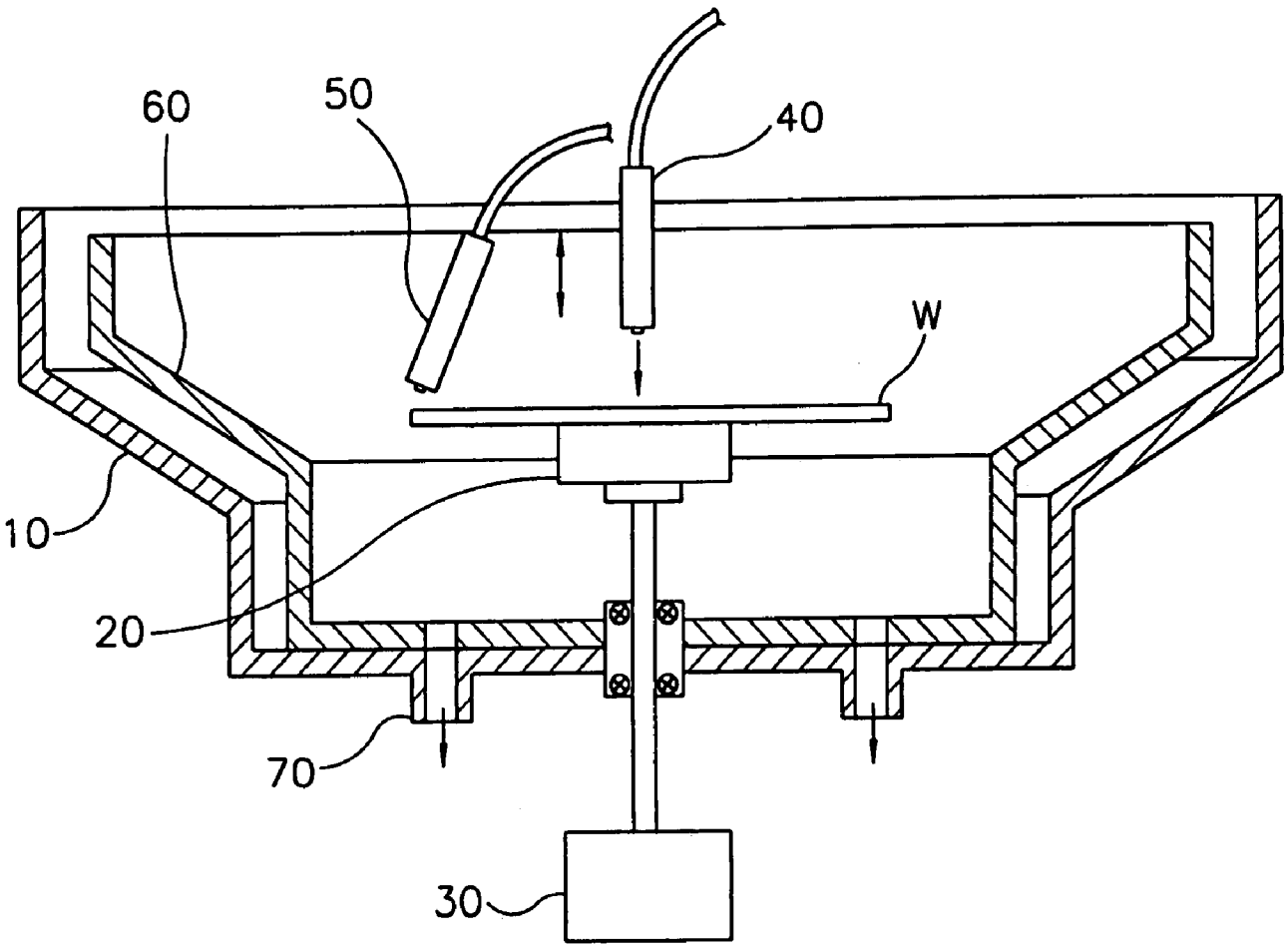
FIG. 1 is a cross-sectional, schematic view of an equipment for coating a photoresist or an organic ARC composition on a semiconductor wafer.
Figure 2A:
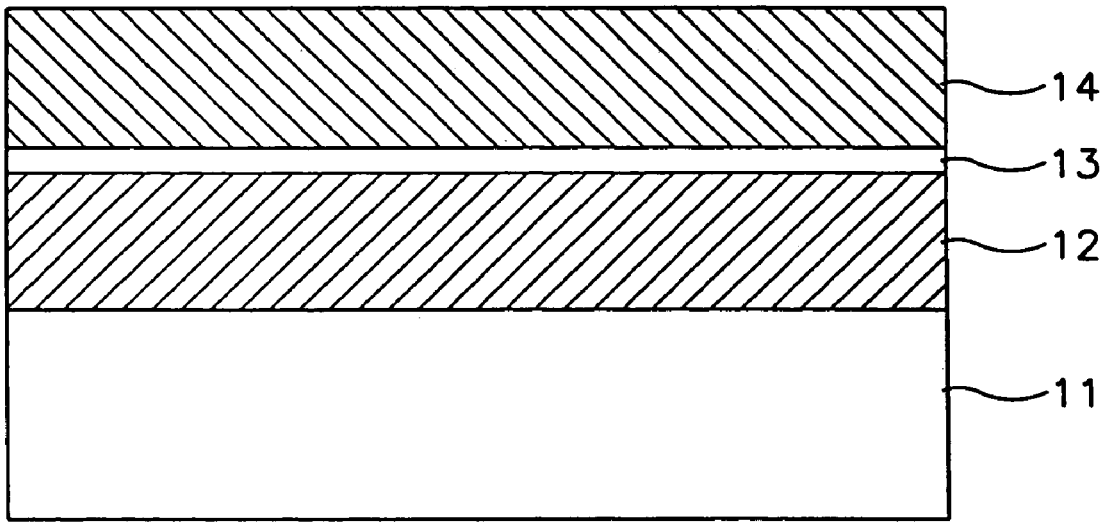
FIGS. 2A–2E are cross-sectional views of a semiconductor device illustrating a cleaning method in a semiconductor process in which an organic ARC layer is applied according to a preferred embodiment of the present invention.

Referring to FIG. 2A, an insulating layer 12 is formed to a thickness of about 4000 Å by depositing an oxide such as PEOX (oxide formed by a Plasma Enhanced CVD method) on a semiconductor substrate 11. On the insulating layer 12, an anti-reflective layer 13 is formed by coating an anti-reflective composition on a wafer using the equipment shown in FIG. 1. As a preferred anti-reflective composition, EUV44 (Nissan Chemical Co.), SNAC90 (Nissan Chemical Co.), etc. may be used. In these ARC compositions, the basic resin includes polyacrylate, wherein a portion of the polyacrylate is replaced with an anthracene group. Also included is a cross-linking agent as an additive. When this component is coated on the insulating layer and then heated, a cross-linked polymer which is insoluble in most of the solvents is formed by the cross-linking agent.

The thickness of the anti-reflective layer is variable according to the refractive index thereof. Generally, the thickness is about 400–600 Å. The anti-reflective layer reduces the refractive coefficient of an exposing light during a photolithography process and also reduces undesired effects due to a reflection of light by an underlying layer.

On the anti-reflective layer 13, an appropriate photoresist is coated to a thickness of about 10,000 Å using the equipment shown in FIG. 1 to form a photoresist film 14.

Figure 2B:
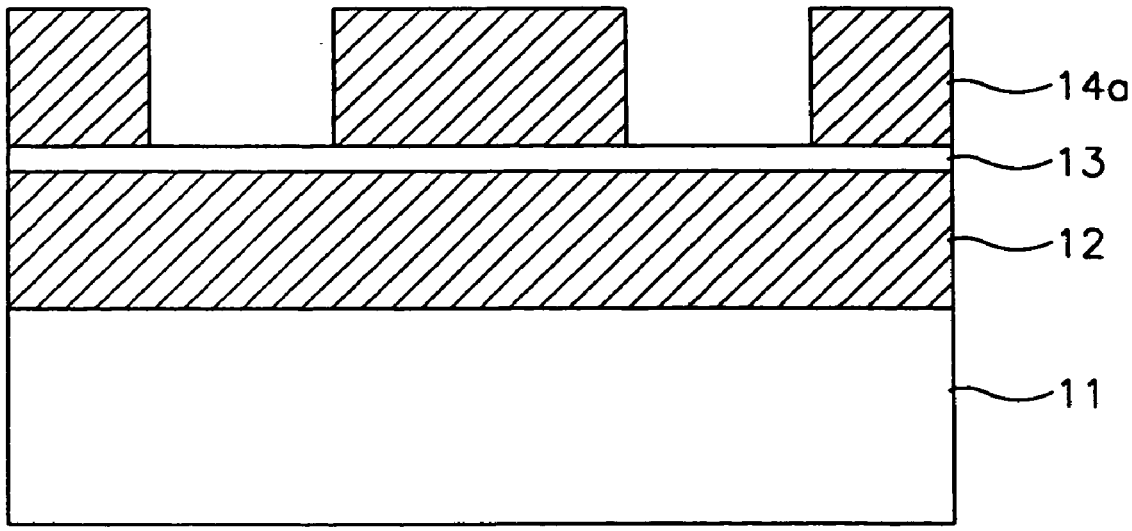

Referring to FIG. 2B, a photoresist pattern 14*a* is formed by exposing a predetermined region of the photoresist film 14 using a mask pattern having a predetermined pattern and then developing the exposed photoresist film 14 to remove a soluble portion of the photoresist film 14. During the exposure, the anti-reflective layer prevents the reflection of the light by the underlying layer to improve a pattern profile.

Figure 2C:
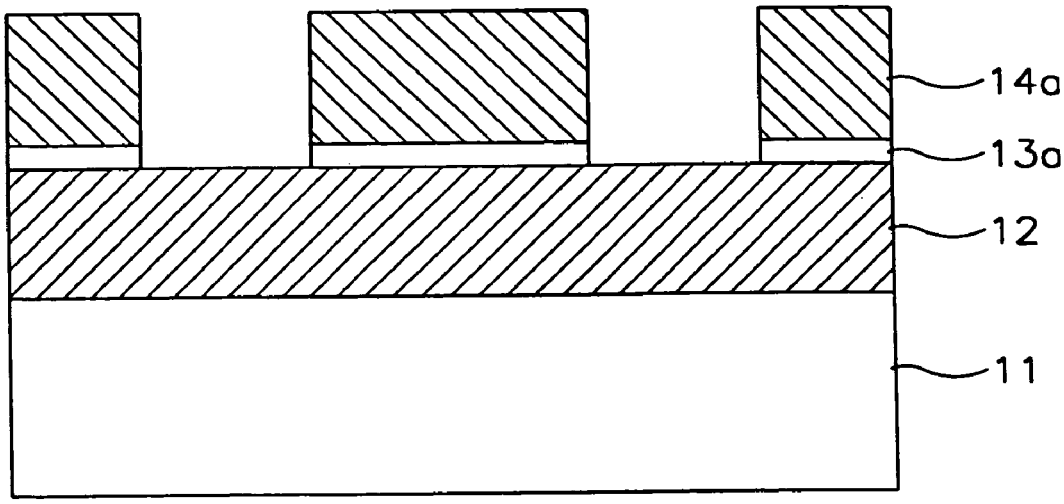

Referring to FIG. 2C, an exposed anti-reflective layer by the photoresist pattern 14*a* is removed by a general method to obtain an anti-reflective layer pattern 13*a*. The removal of the anti-reflective layer is preferably implemented by a reactive ion etching or an etching using ion. A mixture of oxygen, halogen containing-carbons such as freon, argon, etc. can be used as an etching gas.

Figure 2D:
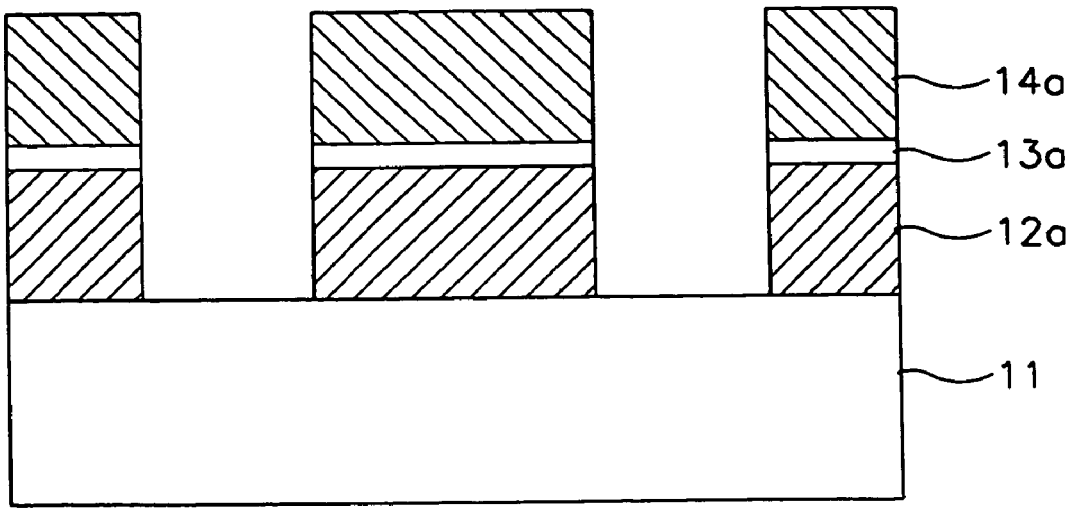

Referring to FIG. 2D, an exposed portion of an underlying insulating layer is anisotropically etched to form an insulating layer pattern 12*a*.

Figure 2E:
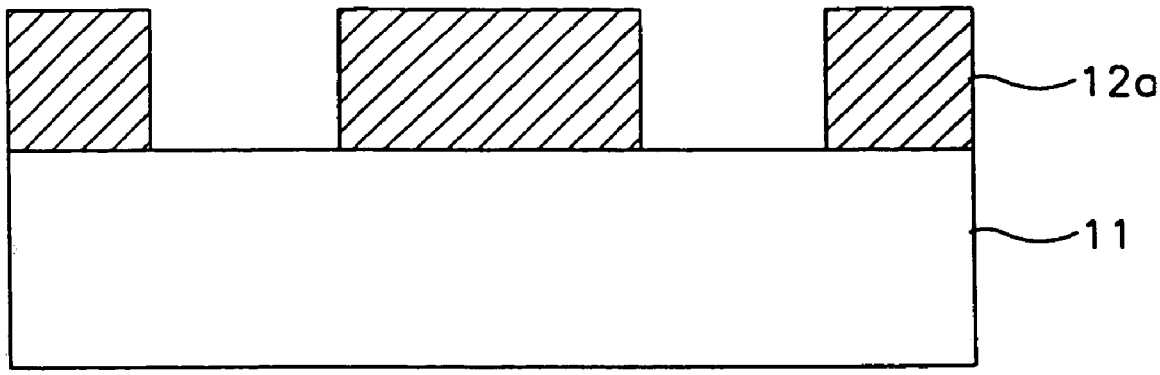

Referring to FIG. 2E, the photoresist pattern 14*a* and anti-reflective layer pattern 13*a* are removed to obtain a desired insulating layer pattern 12*a*.

In order to form the anti-reflective layer and the photoresist film during the procedure of manufacturing the insulating layer pattern, the equipment shown in FIG. 1 is used for the coating of the organic material on the wafer. Spattering of the organic material is inevitable even though the viscosity of the organic materials and the rotational velocity of the wafer are controlled to an optimized condition. Consequently, the spattered ARC and photoresist to the inner container is hardened with the lapse of time. The cured organic material is difficult to remove. In the present invention, a cleaning solution for advantageously removing this cured material is suggested.

As for the ammonium hydroxide salt used as one component of the cleaning solution, at least one salt selected from the group consisting of $(NH_3OH)_2SO_4$, $NH_3OHCl$, $NH_3OHNO_3$ and $(NH_3OH)PO_4$ may be used. Among these compounds, $(NH_3OH)_2SO_4$ is most preferred when considering a swelling effect and stability. The additional amount of ammonium hydroxide salt is within the range of about 5–30% by weight. If the amount is less than 5% by weight, the swelling effect is weak and the cleaning of the organic ARC is not advantageous. If the amount exceeds 30% by weight, the amount of the organic solvent and water is reduced and so the solubility is reduced. The more preferred amount is in the range of about 7–13% by weight.

As for the organic solvent, acetone, acetonitrile, MIBK (methyl isobutyl ketone), a mixture thereof, etc. may be used. Among these solvents, acetone is most preferred. After repeating a large number of experiments by the present inventors, it was found that alcohol solvent is not applicable because the salt is re-precipitated, and a non-polar solvent is not applicable because this non-polar solvent is not miscible with water.

An additional amount of the organic solvent is in the range of about 23–70% by weight. If the amount is less than 23% by weight, the solubility is reduced. If the amount exceeds 70% by weight, the amount of the salt should be reduced and the swelling effect becomes weak. More preferred additional amount of the organic solvent is in the range of about 45–50% by weight.

Meantime, water dissolves the salt and increases the polarity of the cleaning solution. The additional amount of water is in the range of about 10–50% by weight. If the amount is less than 10% by weight, the salt is not completely dissolved, and the cleaning effect becomes weak. If the amount exceeds 50% by weight, the swelling effect and the solubility are decreased. A more preferred amount of water is in the range of about 25–35% by weight.

A method of cleaning an equipment by using the cleaning solution will be described below.

First, an equipment onto which cured photoresist or organic ARC is adhered is detached and dipped into the cleaning solution at room temperature. At this time, a plurality of the equipment is dipped according to the volume of the cleaning solution. The plurality of equipment is simultaneously dipped into the cleaning solution and left for about 10 minutes. The dipping time is determined by a cleaning period and the amount of the cured organic material. When the cleaning period is long and the amount of the organic material is large, the dipping time is prolonged and when the cleaning period is short and the amount of the organic material is small, the dipping time is shortened. Therefore, the dipping time is not limited to a certain time period.

According to repeated experiments by the present inventors, it was confirmed that a dipping time of about 10 minutes is sufficient. When the equipment is taken out of the solution, most of the organic materials are swelled and washed out. The remaining organic materials may be removed during implementing a rinsing process afterwards. Otherwise, a light rubbing using a wiper such as gauze may be applied depending on the degree or amount of the cured degree.

The rinsing process is preferably implemented by rinsing once using acetone. This rinsing process is implemented to confirm the complete washing of a remaining particle on the surface of the equipment. In addition, since acetone is a very strongly volatile material, the drying time can be shortened. Of course, the rinsing can be implemented by using water, however, the drying time is very long and is not recommended.

As described above, the cleaning solution of the present invention is applicable to almost all of insoluble ARCs, and therefore, an inner container surrounding a wafer during implementing a photolithography, can be advantageously cleaned by using this solution.

Comparatively, cleaning takes about 30 minutes per one equipment using the conventional method. However, in the present invention, a number of equipment may be treated at once according to the volume of the cleaning solution. In addition, the cleaning needs about 15 minutes in total by summing the dipping time and the rinsing time to improve the production efficiency.

While the present invention is described in detail referring to the attached embodiments, various modifications, alternate constructions and equivalents may be employed without departing from the true spirit and scope of the present invention.

What is claimed is:

1. A cleaning solution comprising about 5–30% by weight of ammonium hydroxide salt, about 23–70% by weight of an organic solvent and about 10–50% by weight of water.

2. The cleaning solution as claimed in claim 1, wherein the ammonium hydroxide salt is at least one selected from the group consisting of $(NH_3OH)_2SO_4$, $NH_3OHCl$, $NH_3OHNO_3$ and $(NH_3OH)PO_4$.

3. The cleaning solution as claimed in claim 1, wherein the organic solvent is at least one selected from the group consisting of acetone, acetonitrile and MIBK (methyl isobutyl ketone).

4. The cleaning solution as claimed in claim 1, wherein the amount of the ammonium hydroxide salt ranges from about 7% to about 13% by weight.

5. The cleaning solution as claimed in claim 1, wherein the amount of the organic solvent ranges from about 45% to about 50% by weight.

* * * * *